United States Patent [19]

Altshuler

[11] Patent Number: 4,633,263

[45] Date of Patent: Dec. 30, 1986

[54] CORONA MODE ELF ANTENNA SYSTEM

[76] Inventor: Saul Altshuler, 608 15th St., Manhattan Beach, Calif. 90266

[21] Appl. No.: 648,544

[22] Filed: Sep. 7, 1984

[51] Int. Cl.[4] ..... H01Q 1/28

[52] U.S. Cl. ..... 343/706; 343/700

[58] Field of Search ..... 343/706, 877, 700 R, 343/707

[56] References Cited

U.S. PATENT DOCUMENTS

| | | | |
|---|---|---|---|
| 2,433,344 | 12/1947 | Crosby | 343/706 |
| 3,142,063 | 7/1964 | Goetzmann | 343/706 |
| 3,215,937 | 11/1965 | Tanner | 325/28 |
| 3,670,247 | 6/1972 | Gutton et al. | 325/28 |
| 4,051,479 | 9/1977 | Altshuler | 343/706 |

OTHER PUBLICATIONS

"Some Early Historical Projects of Sanguine", by John Merrill; IEEE Transactions on Communications; Apr., 1974; pp. 359-363.

*Primary Examiner*—Eli Lieberman

*Attorney, Agent, or Firm*—Robert A. Seldon

[57] ABSTRACT

An antenna system for radiating information in the ELF range is disclosed and comprises an extended conductor sized to produce a corona at the operating voltage. In the preferred embodiment, "ultra-thin" wire is used as the antenna element for weight savings and is lofted by means of a tether line which absorbs the stresses. Means are provided for helically winding the antenna element around the tether line.

13 Claims, 2 Drawing Figures

CORONA MODE ELF ANTENNA SYSTEM

BACKGROUND OF INVENTION

This invention relates to communication systems for use in the extremely low frequency range (ELF) and, more particularly, to antenna systems for use with such systems. ELF communication systems operate at carrier frequencies which are generally between 10 Hz and 1000 Hz and frequently less than 150 Hz. This frequency range is recognized as being highly useful for large distance communication and for communication with submerged vessels.

Despite the acknowledged advantages of ELF communication, the weight and dimensions of suitable antenna systems have posed serious obstacles in planning for the storage and deployment of ELF antenna systems. This is particularly true where the antenna is to be carried by a vehicle or vessel.

ELF wavelengths are typically about 3000 km so that the antenna element of such antenna systems as horizontal and vertical dipoles must be impractically long in order to radiate efficiently. Previously proposed ELF communication systems have addressed the problem of deployment by proposing the burying of antenna elements or the use of utility lines as the antenna elements. Because vertical dipoles are preferable to horizontal antennas, owing to their more efficient radiation of power, the suspension of a vertical ELF dipole from a blimp or balloon has also been proposed. This latter concept is discussed in my U.S. Pat. No. 4,051,479 issued Sept. 27, 1977, the contents of which are hereby incorporated by reference. Although the use of such an antenna system is particularly attractive for mobile applications, a practical and severe limitation has been the weight of the conductor forming the antenna element, which is typically a metal wire. For convenience, the antenna element will be described as a wire although those skilled in the art will recognize that an antenna element of any cross-sectional shape is within the scope of the invention.

The weight of the antenna element limits the means by which the antenna can be lofted. It is highly desirable to use handloftable, rapidly deployable, inexpensive means such as balloons, kites, parafoils, and so forth. Each of the foregoing, however, has limited lifting capacity, particularly when one wishes to minimize the physical size of the deploying means in order to decrease the risk of detection, the storage size and/or, if applicable, the inflation time.

The weight of the antenna element can be reduced by minimizing the diameter of the antenna element. However, it has heretofore been believed by those skilled in the art that the wire diameter could not be reduced below a critical minimum, described more fully below, in order to avoid a coronal discharge at the operating voltage.

A vertical antenna is a high impedance device which accordingly requires high voltages between the wire and ground to obtain currents capable of producing useful radiated power. Wires which are thinner than the critical minimum diameter referred to above, cannot be subjected to high operating voltages without producing copious ionization in the vicinity of the wire surface. This phenomenon of space charge production is known as corona.

Corona occurs when the electric field near the antenna element causes the air to break down. Antennas have conventionally been operated below the corona inception voltage to avoid corona power loss and noisy currents in the antenna circuit. Stated alternatively, the diameter of the antenna element has always been relatively large to avoid corona at the operating voltage, since the strength of the electric field surrounding the antenna element is inversely proportional to wire diameter.

In the case of ELF frequencies where useful radiated signal strength necessarily requires long conducting wires, large diameters result in heavy conductors and substantial wind loading. Accordingly, large and/or expensive lofting vehicles are needed.

SUMMARY OF THE INVENTION

The invention herein comprises an ELF antenna system which is sized to operate in the corona-generating mode; that is with a space charge envelope substantially surrounding the antenna element. The diameter of the wire forming a typical antenna element can accordingly be significantly reduced for a given operating voltage. Alternatively, a substantially greater current can be coupled into an antenna element of given diameter than heretofore thought achievable, thereby radiating more power than conventionally used "voltage-limited" systems. In both cases the effective diameter of the antenna conductor is increased.

The term "ultra-thin" will be used to denote the relative diameter of the antenna element employed herein. Specifically, the diameter of the antenna element is sufficiently small to allow for generation of a corona at the operating voltage, and sufficiently large to avoid excessive ohmic heating.

The use of "ultra-thin" wire as an antenna element substantially reduces or eliminates the weight-related and storage-related problems associated with prior ELF antenna systems. Further, improved deployment means become available owing to the weight reduction as well as to a reduction in wind loading associated with the thinner wire. For example, vehicles and vessels can raise an antenna aloft using such passive means as kites or balloons or such active means as manned and unmanned aircraft.

Since inexpensive lofting means can be used as part of the antenna system, a disposable ELF antenna system may be constructed wherein the deployed antenna element is cut loose rather than retracted.

It should also be noted that an antenna constructed in accordance with the invention can actually radiate more useful signal power than a conventional ELF antenna of equal weight. The basis for this feature is the fact that the radiated signal power for an ELF vertical dipole is proportional to the fourth power of wire length. Since the reduced diameter of the antenna element herein results in weight savings, that savings can be partially or fully offset by increasing the length of the antenna element. Thus, even where sufficient capability is available to loft the thicker prior art antenna, the subject antenna still provides a substantial increase in radiated signal strength.

Further, the current generated in the antenna circuit is increased by the existence of corona. Corona ionization adds a component of current to the current generated in the antenna circuit, thereby increasing the radiated power. The presence of higher frequency components in the radiated field caused by the corona current does not degrade information transfer efficiency because of the natural filtering of the high frequency components by the earth/ionospheric waveguide.

These and other features of the invention will be explained in greater detail in the following Description of the Preferred Embodiment, of which the following drawing is a part.

DESCRIPTION OF PREFERRED EMBODIMENT

To investigate the power loss associated with a corona-generating ELF antenna element, an 88.7 m long copper wire having a diameter of 0.01 cm was lofted by means of a balloon and driven non-resonantly by a power transformer. The antenna was operated at a 60 Hz AC voltage of 35 KV, maximum, well above the corona inception voltage of 10 KV.

Figure 1:
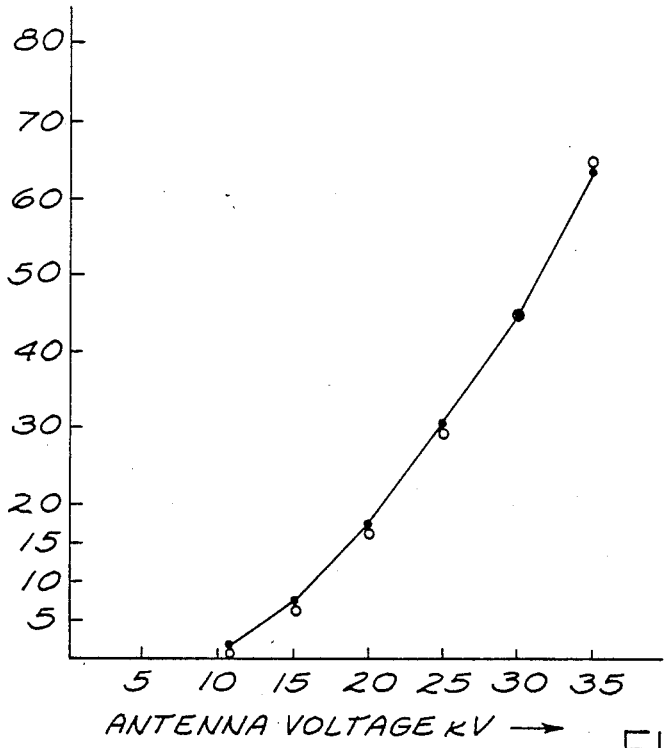
FIG. 1 is a graphic illustration showing corona-induced power loss as a function of antenna voltage.

FIG. 1 is a graphic illustration showing the emperically derived corona power loss in the aforementioned vertical antenna as a function of antenna voltage. FIG. 1 also shows the theoretical power loss derived according to equation 1:

$$P = \frac{4f\cos}{9 \times 10^3}(0.82\alpha)V(V - V_c)\left(\frac{1}{\ln\frac{l}{V}} - \frac{1}{\ln\frac{l}{a}}\right)\frac{\text{watts}}{\text{meter}} \quad (1)$$

$$\text{where: } L = \sqrt{\frac{0.85 \times 10^3\cos(0.41\alpha)\dot{V}K\dot{\alpha}}{f\ln\frac{1}{a}}}\ \text{cm}$$

$V_c =$ corona inception voltage
$V =$ antenna voltage (kv(rms))
$f =$ freq. (Hz)

$$K = \text{ionic mobility}\left(\frac{\text{cm}^2}{\text{msec}}\right) = 2.12 \text{ at STP}$$

$a =$ wire radius (cm)
$l =$ wire length $$\cos\alpha = \frac{V_c}{V}$$

The corona inception voltage, $V_c$, can be calculated using equation 2:

$$V_c = 21.2a\delta\ln\left(\frac{l}{a}\right)\left(1 + \frac{0.308}{\sqrt{a\delta}}\right)\text{kv(rms)} \quad (2)$$

From FIG. 1, one can observe good correlation between the theoretical and empirical values for power loss. On the basis of Equations 1 and 2, a power loss of only 15 kw will be experienced for an ELF vertical antenna element having a length of 3 km, a radius of 0.01 cm and operated at 100 kv in the ELF range. The Q of the system is 10, which is a convenient operating value. The radiated output power is approximately $10^{-2}$ watts.

The use of an antenna system comprising an array of "ultra-thin" elements is within the scope of the invention. Owing to the large wavelengths involved in ELF communications, the elements may be arbitrarily located on the earth's surface so long as they are within one wavelength of each other. The antenna elements may conveniently be individually lofted from an appropriate remote command control center. When N individual elements of an array are driven synchronously, an omnidirectional power output of $N^2 \times 10^{-2}$ watts is obtained despite the fact that the signal from each antenna elements is "noisy" owing to the presence of the surrounding corona envelope. An array of noisy antenna elements does not conventionally provide an $N^2$ power increase. This invention allows the field at a distant receiver to be noise free owing to the filtering action of the propagation channel; namely the earth-/ionosphere waveguide. Therefore, the received signal strength is equal to the coherent sum of the fields generated by the individual antenna elements. Accordingly, the noisy elements may form an effective array. Of course, adequate separation between antenna elements must be maintained so that the antennas do not drive each other. In practice, a separation equal to two or three times the length of the antenna element is sufficient.

An array of antenna elements is preferable in that radiation efficiency increases. In theory, one can also increase the radiation efficiency of an antenna element by simply adding length. However, the addition of length increases coronal power loss, windloading, and antenna weight. The addition of synchronously driven antenna elements to form an array effectively forms an equivalent single conductor having a length equal to the sum of the lengths.

The break-strength of an ultra-thin wire need not limit the thinness of wire employed in the described antenna system. An alternative embodiment of the invention includes a tether line, about which the ultra-thin wire is generally helically wound. The tether line is lofted by such means as a balloon and experiences the tension from wind loading, its own weight, the weight of the ultra-thin wire, and the upward lift of the lofting device.

Figure 2:
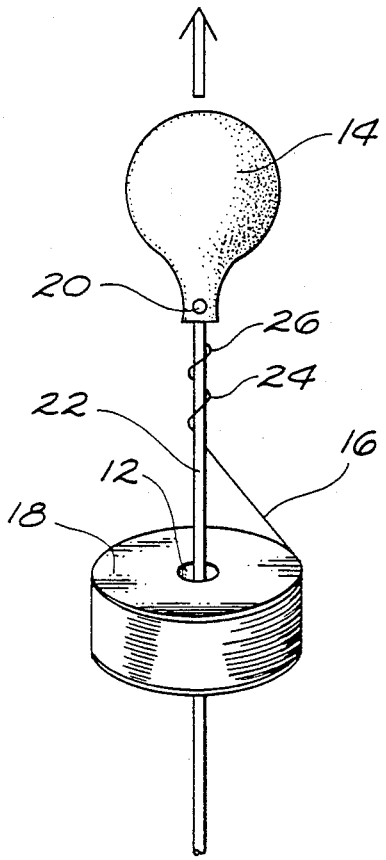
FIG. 2 is a schematic illustration of a partially lofted ELF antenna element constructed in accordance with the invention.

FIG. 2 is a schematic illustration of an ELF antenna system constructed in accordance with the invention. "Ultra-thin" wire 16 is stored in a generally coiled configuration prior to deployment by means such as a spool 18. The spool 18 contains a generally central through bore 12 sized to accomodate a tether line 22. The tether line 22, shown enlarged for clarity, passes axially through the bore 12. The leading end portion of the tether line 22 is coupled to the leading end portion of the antenna wire 16 such as at 20.

The leading end of the tether line 22 is coupled to a balloon 14 or other means capable of lifting the tether line generally vertically.

The balloon is inflated and deployed. As the tether line 22 rises vertically, it causes the antenna wire to uncoil and wrap itself helically around the tether line. In FIG. 2, the helical wrapping of the antenna wire 16 is shown illustratively. In practice, the distance between the loops (e.g., 24, 26) may be much greater.

Naturally, the supporting of the antenna wire by a tether line can be achieved through numerous equivalent means. For example, the tether line need not pass through the spool, but need only be directed away from the spool in a similar relative direction. For example, the tether line 22 illustrated in FIG. 2 could simply be guided generally radially into the area above the spool 18 for coupling with the antenna wire. Alternatively, the antenna wire can be pre-wrapped about the tether and stored in its pre-wrapped state. For example, a multi-strand antenna element can include one or more Kevlar TM strands, braided with one or more "ultra-thin" strands of electrically conductive antenna wires.

The ultra-thin wire coiled about the tether line requires very minimal break-strength. First, it bears no appreciable wind load. Secondly, if twisted, it experiences no torsion because of its coiling about the tether. Thirdly, it experiences little or none of the tension caused by the upward pulling of the lofting device. Fourthly, due to its coiling about the tether line, it is substantially fully supported along its length and accordingly supports little of its own weight.

To minimize its own weight and wind loading, the tether should also be as thin as possible, but have adequate breakstrength. Examples of suitable tether materials are Dacron, Nylon and Kevlar, which are materials used in the highly developed fishing line technology. Accordingly, an antenna system using the following components has been constructed in accordance with the foregoing criteria and field tested:

| | |
|---|---|
| lofting device: | 7 ft. diameter balloon<br>14.3 lb lift |
| tether: | Dacron fishing line<br>0.03 in./dia. × 9700 ft. length<br>wt: 2.75 lbs.<br>break-strength: 50 lbs. |
| antenna element: | 0.008 in./dia. copper wire<br>break-strength: 2.5 lbs.<br>wt.: 1.9 lbs. |

A resonant 9700 ft. ELF antenna system was built and successfully field tested utilizing the above components, together with a 230 henry tuning inductor and a variable frequency and voltage generator. Because the vertical antenna element forms a capacitor with the ground, a tuned RLC circuit is formed. Those skilled in the art will recognize that the foregoing vertical conductor radiates at the resonant frequency as an electrical dipole, and can be used to transfer information most conveniently by well-known frequency modulation methods.

While the foregoing description includes detailed information which will enable those skilled in the art to practice the invention, it should be recognized that the description is illustrative only and that many equivalent methods and apparatus may be employed to carry out the invention. For example, the antenna elements may be deployed downward from elevated platforms such as manned or unmanned planes rather than being lofted. One or more weights coupled to the tether could insure a generally vertical deployment.

Accordingly, it is intended that the invention be defined only by the appended claims, the scope of which should be interpreted as broadly as possible in light of the prior art.

I claim:

1. An antenna system suitable for radiating information in the ELF range comprising:

an extended conductor; and means for coupling an ELF voltage to the conductor;

the relationship between the conductor size and voltage being such that the electric field immediately adjacent at least a portion of the conductor exceeds the air break-down field strength, producing corona without corona discharge to increase the effective diameter of the antenna conductor.

2. The antenna system of claim 1 wherein the conductor has a diameter in the order of 0.01 centimeters.

3. The antenna system of claim 1 including lofting means for carrying at least one end of the extended conductor upward from the earth's surface.

4. The antenna system of claim 3 wherein the lofting means includes a passive device selected from the group consisting of kites, balloons, and parafoils.

5. The antenna system of claim 3 wherein said lofting means includes a tether means for supporting the extended conductor and for substantially isolating said extended conductor from tension and strain.

6. The antenna system of claim 3 including means for remotely lofting the extended conductor.

7. The antenna system of claim 5 including spool means for storing the extended conductor in a generally coiled configuration about an axis; and means for helically placing the extended conductor on a tether line as the tether line is lofted.

8. The antenna system of claim 7 including means for guiding the lofting tether line generally axially from the stored conductor so that the uncoiling conductor wraps generally helically about the tether line.

9. The antenna system of claim 8 including spool means for storing the extended conductor in a generally coiled configuration about a through-bore formed in the spool means, said through-bore being sized to accomodate the tether line passing through the bore; and means for mechanically coupling one end portion of the extended conductor to the end portion of the tether line first emerging from the bore whereby the extended conductor wraps helically about the tether line as the tether line is lofted.

10. An antenna system suitable for radiating information in the ELF range comprising:

an extended conductor; and means for coupling an ELF voltage to the conductor;

the relationship between the conductor size and voltage magnitude being such that the electric field immediately adjacent to at least a portion of the conductor generates a corona envelope to increase the effective diameter of the antenna conductor.

11. An antenna system suitable for radiating information in the ELF range comprising;

an array of extended conductors;

means for coupling an ELF voltage to each of the conductors in general synchrony;

the relationship between at least one of the conductors and the magnitude of the ELF voltage coupled thereto being such that the electric field immediately adjacent to at least a portion of the conductor exceeds the air break-down field strength without corona discharge to increase the effective diameter of the antenna conductor.

12. The antenna system of claim 11 wherein the array comprises a plurality of generally vertical conductors.

13. The antenna system of claim 12 wherein the spacing between conductor pairs is randomly greater than three times the length of the conductors forming the pair.

* * * * *